United States Patent [19]

Hoerkens

[11] Patent Number: 4,713,946

[45] Date of Patent: Dec. 22, 1987

[54] ORNAMENTAL CHAIN

[76] Inventor: Reiner Hoerkens, Bahnhofstrasse 31, D-6903 Neckargemünd, Fed. Rep. of Germany

[21] Appl. No.: 829,495

[22] Filed: Feb. 14, 1986

[30] Foreign Application Priority Data

Mar. 4, 1985 [DE] Fed. Rep. of Germany ..... 3507546

[51] Int. Cl.[4] ..... A44C 11/00

[52] U.S. Cl. ..... 63/4; 24/403; 24/409; 59/93; D11/221

[58] Field of Search ..... 63/3, 4, 9; 24/419, 24/587, 429, 403, 409, 411, 410, 413; D11/221, 79, 3, 4; 59/93, 80

[56] References Cited

U.S. PATENT DOCUMENTS

| | | | |
|---|---|---|---|
| D. 117,671 | 11/1939 | Kay | D11/221 |
| 896,686 | 8/1908 | Canfield | 24/429 |
| 2,385,020 | 9/1945 | Morin | D11/221 |
| 2,748,439 | 6/1956 | Owen | 24/429 |
| 2,856,661 | 10/1958 | Holl | 63/4 X |
| 4,521,942 | 6/1985 | Oda | 24/420 |

FOREIGN PATENT DOCUMENTS

| | | | |
|---|---|---|---|
| 3407897 | 5/1985 | Fed. Rep. of Germany | 172/4 |
| 1120161 | 4/1956 | France | 63/4 |
| 2509970 | 1/1983 | France | 172/4 |

OTHER PUBLICATIONS

Gift and Tableware Reporter, 1-1978, p. 59, Advertisement of Towle Silversmiths Newfuryport MA.

*Primary Examiner*—Richard J. Johnson

*Attorney, Agent, or Firm*—Balogh, Osann, Kramer, Dvorak, Genova & Traub

[57] ABSTRACT

In an ornamental chain, a multiplicity of teeth are arranged in two juxtaposed rows. Each of said teeth has a tooth portion directed toward the other row and arranged to extend between and to interengage with two adjacent teeth of the other row so as to interconnect the rows. Each of said teeth has an end portion on that side of the tooth portion which is remote from the other row. The end portion of each of said teeth of each row comprises two crosspieces, which are spaced apart along the row and extend transversely to a plane containing the chain when it lies on a flat support. A plurality of rings are provided, each of which surrounds two adjacent ones of said crosspieces of adjacent teeth of the same row. The crosspieces and the rings constitute the interconnecting means. Each of the rings connecting the teeth of each row is adapted to interengage with the tooth portion of a tooth of the other row to restrict the movement of the tooth portion transversely to the plane. The end portion of each of the teeth is formed at least on one side with a concave recess. The tooth portion of each of the teeth is formed at least on one side with a convexly curved portion adapted to extend into said concave recess of a tooth of the other row.

15 Claims, 7 Drawing Figures

Fig. 1
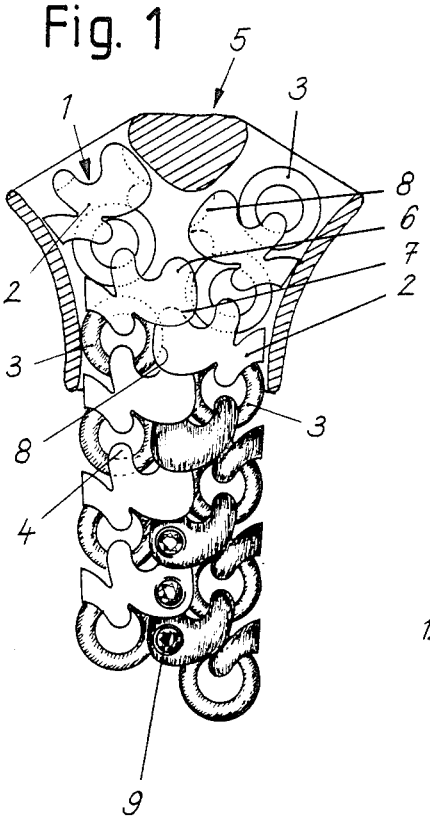
Fig. 2
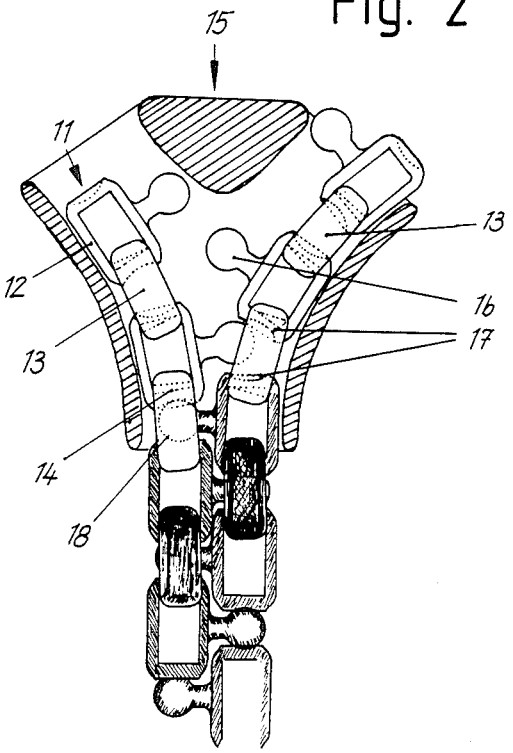
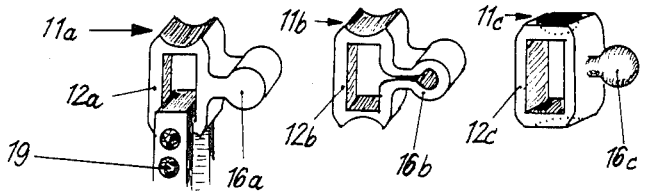
Fig. 2b Fig. 2c
Fig. 2a

ORNAMENTAL CHAIN

BACKGROUND OF THE INVENTION

FIELD OF THE INVENTION

This invention relates to an ornamental chain, which is adapted to be closed, such as a necklace which is adapted to be partly closed. Said chain comprises teeth, which are arranged in two juxtaposed rows and adapted to interdigitate and interlock when the chain is closed, and a slider, by which the chain can be opened and closed like a slide fastener. In said ornamental chain, each tooth has a tooth portion directed toward the other row and adapted to extend between two adjacent teeth of the other row, and an end portion, and means are provided by which end portions of adjacent teeth of the same row are relatively movably connected to each other.

French Patent Specification No. 2,509,970 discloses an ornamental chain, which is adapted to be partly closed and comprises teeth which are arranged in two rows. The teeth of each row are spaced apart and adapted to interdigitate with the teeth of the other row. That chain is adapted to be opened and closed like a slide fastener by means of a slider. In that known chain, which is similar to a slide fastener, the end portions of the teeth of each row are interconnected by means of flexible strings. Because the teeth of each row are interconnected by continuous strings and owing to the proposed design of the chain, that chain is not sufficiently flexible for use as an ornamental chain and the concept cannot be used in fabrics comprising more than two rows of teeth.

The concept disclosed in the prior publication mentioned hereinbefore cannot be adopted in ornamental chains which are similar in appearance to anchor chains or crawler chains or in Venetian chains.

SUMMARY OF THE INVENTION

It is an object of the invention to provide an ornamental chain which can partly be closed like a slide fastener.

It is another object of the invention to provide such chains which are similar in appearance to anchor chains or crawler chains or which consist of Venetian chains.

It is a further object of the invention to provide such chains in which the teeth can be arranged in more than two rows to constitute an ornamental fabric.

It is a still further object of the invention to provide such chains which are highly flexible and can be made by machine to a large degree.

In one aspect of the invention said object can be accomplished in that the rear portion of each tooth of each row comprises two crosspieces, which are spaced apart along the row and extend transversely to the plane which contains said chain when it lies on a flat support. Adjacent crosspieces of adjacent teeth of the same row are surrounded and movably interconnected by a ring. The tooth portion of each tooth of each row has a convexly curved portion, which fits a concave recess of a tooth of the other row. The rings connecting the teeth of each row interengage with the tooth portions of the teeth of the other row.

In another aspect of the inventions the objects set forth hereinbefore are accomplished in that the end part of each tooth is provided with two crosspieces, which are spaced apart along the row of teeth and extend transversely to the plane which contains said chain when it lies on a flat support. Adjacent crosspieces of adjacent teeth of the same row are movably interconnected by a ring surrounding said adjacent crosspieces, which ring extends transversely to said plane. The end portion of each tooth has mutually opposite side faces formed with respective recesses. The tooth portion of each of said teeth has convexly curved portions extending into said recesses of two adjacent teeth of the other row. Each of said teeth of each of said rows is surrounded by a ring connecting the teeth of the other row and restricting the movement of the surrounded front portion transversely to said plane.

Further details of the ornamental chain in accordance with the invention are apparent from preferred illustrative embodiments, which are shown on the drawing and will now be described with reference thereto.

BRIEF DESCRIPTION OF THE DRAWING

FIG. 1 is a top plan view showing a first embodiment of an ornamental chain.

FIG. 2 is a top plan view showing a second embodiment of an ornamental chain.

FIGS. 2*a* to 2*b* are perspective views showing teeth which can be used in the chain of FIG. 2.

DETAILED DESCRIPTION OF THE PREFERRED EMBODIMENTS

Figure 3:
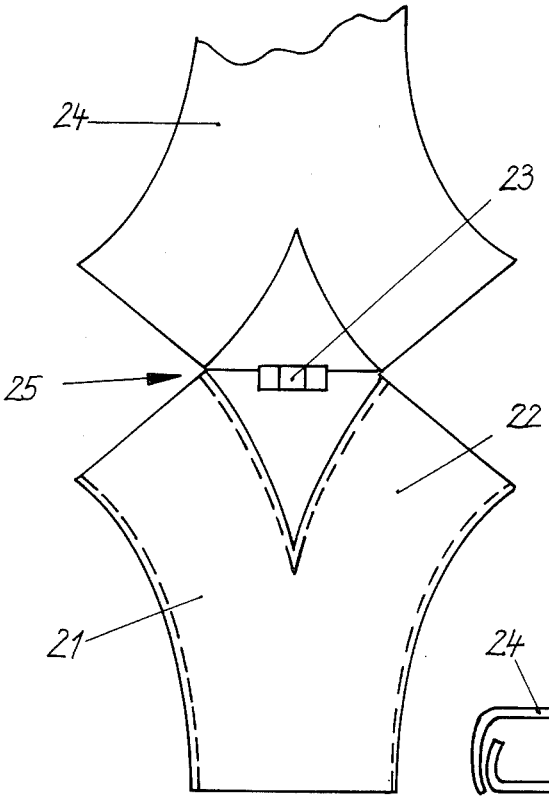
FIGS. 3 and 3*a* are respectively, an elevation and a sectional view showing a slider for opening and closing the chain as in a slide fastener. The slider comprises a baseplate and a cover, which has been swung open from the baseplate in FIG. 3 and closed in FIG. 3*a*.

In the first embodiment shown in FIG. 1, the teeth of each row have curved rear portions 2, each of which has two crosspieces 4, which are spaced apart along the row and extend at right angles to a plane which contains the chain when it lies on a flat support. Adjacent teeth of the same row are relatively movably connected by a ring 3, which surrounds two adjacent crosspieces 4 of adjacent teeth of the same row.

The chain can be closed by means of a slider 5, which is operated to cause a convexly curved portion of a laterally protruding finger portion 6 of the forward portion of each tooth to move into a recess 7, which is formed in the adjacent side face of an adjacent tooth of the other row. A tooth portion of each tooth is formed in its forward end face with a recess 8 for receiving one of the rings 3, which connect the teeth of the other row.

Owing to the provision of rings interconnecting the end portions of the teeth of each row, the ornamental chain is similar in appearance to an anchor chain or crawler chain. The two rows of teeth are interconnected by the interengagement between the convexly curved finger portions 6 and the recesses 7 receiving said finger portions.

When such a chain is closed, it can be used as a bracelet or as a watch strap. In that case the slider 5 is used to assemble the bracelet or strap. The rear or front portions of the teeth may be provided with seats for ornamental stones 9. In the present embodiment, the chain is laterally embraced by the slider 5 and the latter may be open or closed at its top, as is disclosed in Published German Application No. 34 07 897.

In the second illustrative embodiment shown in FIG. 2, each tooth 11 has a framelike end portion 12. Each of the end portions is formed with two crosspieces 14, which are spaced apart along the row of teeth and extend transversely to the plane which contains said chain when it lies on a flat support. The adjacent crosspieces 14 of adjacent teeth 11 of the same row are relatively movably interconnected by a ring 13.

When the chain is closed by means of the slider 15, a tooth portion 16 of each tooth is received by two concave recesses 17, which are formed in the adjacent side faces of two adjacent crosspieces of two adjacent teeth 11 of the other row and each of the rings 13 connecting the teeth of one row is received so that the movement of the tooth portion of each tooth transverse to said plane is restricted at 18 by the ring which connects two adjacent teeth of the other row. Each ring need not extend throughout the length of the tooth portion surrounded by the ring but it will be sufficient for each ring to surround only a neck of a tooth of the other row.

Owing to the provision of rings connecting the end portions of the teeth of each row the chain is similar to a Venetian chain. The tooth portions 16 of the tooth connect the two rows of the chain.

If alternate teeth of each row are provided with tooth portions protruding in mutually opposite directions from the end portions of said teeth, said chain can be used to form an ornamental fabric consisting of more than two juxtaposed and interconnected rows of such teeth. Such a fabric may consist of a wide bracelet, for instance, and will not be provided with a slider 15. Particularly if the tooth-connecting rings are wide, said rings may be provided with seats for ornamental stones 19, such as is shown in FIG. 2*a*.

FIGS. 2*a* to 2*c* show three different embodiments of teeth 11a to 11*c* each of which comprises a end portion 12*a* to 12*c* and a tooth portion 16*a* to 16*c*. FIG. 2*a* shows a stamped tooth, which may alternatively consist of a sheet metal stamping. FIG. 2*b* shows a tooth consisting of bent sheet metal. FIG. 2*c* shows a cast tooth.

Whereas framelike teeth are shown in FIG. 2, the teeth may alternatively consist of substantially solid members which are shaped in three dimensions, as shown in FIG. 1, and in that case may be cast, embossed or stamped.

Figure 3A:
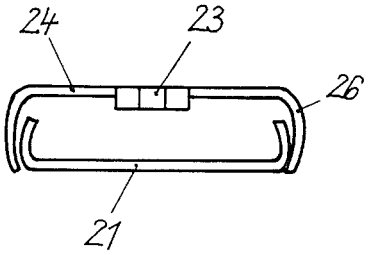

FIGS. 3 and 3*a* show a slider 25, which comprises a baseplate 21 provided with tracks 22 for respective rows of teeth of the chain, and a cover 24, which is connected by a hinge 23 to a raised triangular portion provided on the baseplate 21 between the tracks 22. As a result, the cover 24 can be swung open. The cover 24 has side walls 26, which in the closed position of the cover embrace the track of the baseplate 21. The cover 24 may be made of transparent plastic material or may consist of a plate of noble metal and be provided with a seat for an ornamental stone. Because the cover 24 can be swung open, the slider 25 can be removed from the ornamental chain and may be used as a chain fastener or as a pendant, through which only one row of teeth extends in V-shape. This possibility will increase the versatility of the present ornamental chain.

I claim:

1. In an ornamental chain comprising a multiplicity of teeth arranged in two juxtaposed rows, each of said teeth having a tooth portion directed toward the other row and arranged to extend between and to interengage with two adjacent teeth of the other row so as to interconnect said rows, and interconnecting means connecting adjacent teeth of each of said rows to each other and resisting a separation of adjacent teeth of the same row along said row while permitting adjacent teeth of the same row to move relative to each other when said tooth portions of said teeth of each row are disengaged from adjacent teeth of the other row, the improvement residing in that each of said teeth has an end portion which is remote from the other row, the end portion of each of said teeth of each row comprises two crosspieces, which are spaced apart along said row and extend transversely to a plane containing said chain when it lies on a flat support, a plurality of rings are provided, each of which surrounds two adjacent ones of said crosspieces of adjacent teeth of the same row, said crosspieces and said rings constitute said interconnecting means, each of said rings connecting the teeth of each row is adapted to interengage with said tooth portion of a tooth of the other row to restrict the movement of said tooth portion transversely to said plane, said end portion of each of said teeth is formed at least on one side with a concave recess, and the tooth portion of each of said teeth is formed at least on one side with a convexly curved portion adapted to extend into said concave recess of a tooth of the other row.

2. The improvement set forth in claim 1 wherein each of said tooth portions has an end portion facing the other row and formed with a recess that is open toward said other row and adapted to receive one of said rings connecting adjacent teeth of the other row so as to restrict the movement of said tooth portion transversely to said plane.

3. The improvement set forth in claim 1, wherein each of said tooth portions comprises a laterally protruding finger formed with said convexly curved portion.

4. The improvement set forth in claim 1, wherein each of said end portions of the teeth of each of said rows is formed on each of its mutually opposite sides on its outside surface with a concave recess, each of said tooth portions is formed on two mutually opposite sides with respective convexly curved portions adapted to extend into two adjacent ones of said concave recesses of said end portions of adjacent teeth of the other row, and each of said rings connecting the teeth of one row is adapted to surround one of the tooth portions of a tooth of the other row so as to restrict the movement of said tooth portion transversely to said plane.

5. The improvement set forth in claim 4, wherein each of said end portions of the teeth of each of said rows comprises a frame formed on mutually opposite sides with said crosspieces, which are formed each on its outside surface with one of said concave recesses.

6. The improvement set forth in claim 4, wherein said tooth portions of said teeth are spherical.

7. The improvement set forth in claim 4, wherein said tooth portions are cylindrical.

8. The improvement set forth in claim 1, wherein said end portions of said teeth consist of solids shaped in three dimensions.

9. The improvement set forth in claim 1, wherein said end portions consist of frames.

10. The improvement set forth in claim 1, wherein each of said teeth consists of a flat stamping.

11. The improvement set forth in claim 1, wherein each of said end portions is ornamental.

12. The improvement set forth in claim 1, wherein each of said rings is ornamental.

13. The improvement set forth in claim 1, wherein each of said end portions is provided with a seat for an ornamental stone.

14. The improvement set forth in claim 1, wherein each of said rings is provided with a seat for an ornamental stone.

15. The improvement set forth in claim 1 as applied to an ornamental chain comprising a slider which is movable along said rows so as to accommodate and engage part of said teeth of each of said rows at a time so as to interconnect and disconnect said rows.

* * * * *